United States Patent [19]

Coggiola

[11] 4,107,860

[45] Aug. 22, 1978

[54] STEAM IRON

[75] Inventor: James P. Coggiola, Pomona, Calif.

[73] Assignee: General Electric Company, Bridgeport, Conn.

[21] Appl. No.: 856,265

[22] Filed: Dec. 1, 1977

[51] Int. Cl.[2] ..... D06F 75/06

[52] U.S. Cl. ..... 38/77.83

[58] Field of Search ..... 38/75, 77.1, 77.5, 77.7, 38/77.8, 77.81, 77.83

[56] References Cited

U.S. PATENT DOCUMENTS

| | | | |
|---|---|---|---|
| 3,488,873 | 1/1970 | Risacher | 38/75 |
| 3,711,972 | 1/1973 | Risacher | 38/77.83 |
| 3,811,208 | 5/1974 | Vieceli et al. | 38/77.8 |
| 3,930,325 | 1/1976 | Schaeffer et al. | 38/77.83 |
| 3,986,282 | 10/1976 | Nelson | 38/77.83 |

*Primary Examiner*—Henry S. Jaudon
*Attorney, Agent, or Firm*—John F. Cullen; George R. Powers; Leonard J. Platt

[57] ABSTRACT

In a steam iron with a handle and fill opening to a water tank above an electrically heated soleplate and having a steam generator in the lower rear portion of the iron and soleplate steam ports, and a pump mounted in the handle and connected to the generator to rapdily force a volume of water to the generator for a surge of steam out the ports. To this general known combination, the invention provides an improvement of a bellows pump fixedly supported on an internal wall in the upper forward portion of the handle and completely external of the tank. Connected to one end of the pump is a double tubular conduit with the pump and conduit both being a flexible elastomer heat insulator with one conduit extending through the tank and terminating at and forming an exhaust outlet to the rear generator and the other conduit terminating adjacent the generator and in the tank as a suction inlet to the pump. One-way and position sensitive valves are disposed oppositely in the conduits and the entire double conduit extends in a slanted down direction from the forward pump to the rear generator whereby the iron may be operated in either a horizontal or vertical position to provide surge steam.

5 Claims, 4 Drawing Figures

STEAM IRON

BACKGROUND OF THE INVENTION

1. Field of the Invention

The invention relates to a steam iron of a lightweight plastic with a water tank above an electrically heated soleplate and a rear steam generator and ports to direct steam through the soleplate as shown in U.S. Pat. No. 3,986,282 of common assignment. The invention improves on said patent by providing an elastomer pump and double walled conduit in a combination using fewer parts that are better located and permits the iron to be operated dry, steam, or surge of steam with the surge of steam operable in the vertical position as a steaming device.

2. Description of the Prior Art

The overall combination of a lightweight plastic iron of integral pieces with a rear surge generator and a forward upper pump on the handle permitting surge in either the horizontal or vertical position is shown in U.S. Pat. No. 3,986,282 of common assignment. This iron is operable dry, steam, or surge of steam in both the horizontal and vertical positions. Elastomer bellows pumps per se in an iron handle for pumping water to different parts of an iron, usually with a conventional main steam generator and a soleplate or to a spray nozzle or both are well known as shown in U.S. Pat. Nos. 3,711,972 and 3,488,873. These are merely improved versions over the well-known manual diaphragm pump as shown in U.S. Pat. No. 3,183,611 of common assignment.

SUMMARY OF THE INVENTION

Briefly described, the invention is directed to an improvement on the overall arrangement of assignee's U.S. Pat. No. 3,986,282 that is a steam iron with a handle and fill opening to a water tank above an electrically heated soleplate with a steam surge generator means positioned in the lower rear portion of the iron and steam ports in the soleplate. A handle mounted pump is connected to the generator to rapidly force a volume of surge water to the generator for a surge of steam out the ports. The invention improves on this combination by providing a bellows pump and supporting it on an internal handle wall in the upper forward portion of the handle completely external of the water tank. A double conduit tubular means is connected to the pump at one end to slant down to the surge generator and tank rear at the other end with one of the conduits extending through the tank and terminating at the generator and the other conduit terminating adjacent the generator in the tank rear portion. Internal one-way non-positioned sensitive valves are disposed oppositely in each conduit with the valve, conduit, and pump all of flexible elastomer heat insulating means. The combination uses few parts with the operating pump structure removed from the heat for operation dry, steaming, or surge in both the horizontal and vertical positions. Thus, the main object is to provide an improved iron of the type described that lends itself to all plastic construction, few parts, with the arrangement providing surge both horizontally and vertically and preventing vapor lock in the pumping system.

DESCRIPTION OF THE PREFERRED EMBODIMENT

The invention will be described in connection with steam irons of the general type as shown in U.S. Pat. No. 3,986,282 of common assignment since it is an improvement thereover. It should be understood that various attachments such as conventional spray mechanisms may be applied and the invention is applicable to unpressurized or pressurized irons.

Figure 1:
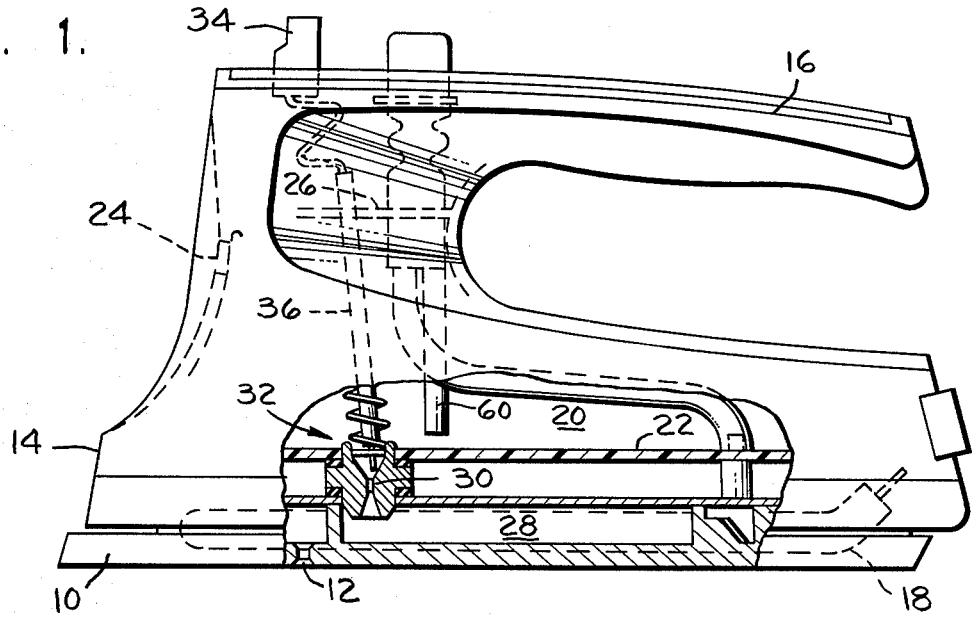
FIG. 1 is an elevational view, partly in section and phantom, showing general parts of a steam iron for horizontal surging.

The invention discloses a steam iron which may be operated dry, steaming, and having an extra surge of steam when desired in either the horizontal or vertical position. This permits operation of the iron as a handy vertical steam as well as a surge iron. Referring to FIG. 1 there is shown an electrical steam iron of the general type shown in U.S. Pat. No. 3,986,282 of common assignment that includes a soleplate 10 having a plurality of steam ports 12 oriented in any suitable manner to direct steam through the soleplate and having an outer metal or preferably plastic shell 14 suitably connected to or integrally formed with closed or open handle 16 as shown. In accordance with conventional practice, soleplate 10 is made from material such as cast aluminum, with and electrical loop-shaped heating element 18 cast in position or, alternately, the soleplate 10 may be a thin soleplate with heating element 18 welded thereto as in U.S. Pat. No. 3,930,325 of common assignment disclosing a wrought soleplate construction. The heating element 18 is controlled from a cord through a thermostatic means in a well known manner.

The iron, formed of complementary and vertically facing symmetrical sealed halves, includes means for generating steam by providing water tank 20 directly above the electrically heated soleplate 10. The tank may be integrally formed of plastic as shown in FIG. 1 with a spaced bottom 22 separating the tank from the heating element 18 with a suitable fill opening 24 and with the shell 14 and an integrally molded internal handle wall 26 completing the tank. For standard steam, a conventional main steam generator 28 is provided in the soleplate in the usual manner or it may be above the soleplate as in U.S. Pat. No. 3,930,325 with the generator feeding suitable distribution passages to exit through soleplate ports 12. Steam is formed by metering water through orifice 30 with water valve structure 32 activated by a steam control means such as button 34 and connected spring-biased vertical stem 36 all in a conventional manner.

In accordance with said U.S. Pat. No. 3,986,282, an invention is disclosed that provides delivery of steam in both horizontal and vertical iron positions while permitting the iron to operate either dry, steam, or surge, in a generaly slanted arrangement from an upper forward control portion in the handle to the lower rear tank portion. In conjunction with this, the pump is located at the lower rear to rapidly force a volume of water to a separate surge steam generator permitting surge steam in both horizontal and vertical positions. This arrangement locates the pump within the tank near the heated soleplate which can permit more heat than desired in the pump area to create a vapor lock in the pump if the temperature gets too high.

Figure 2:
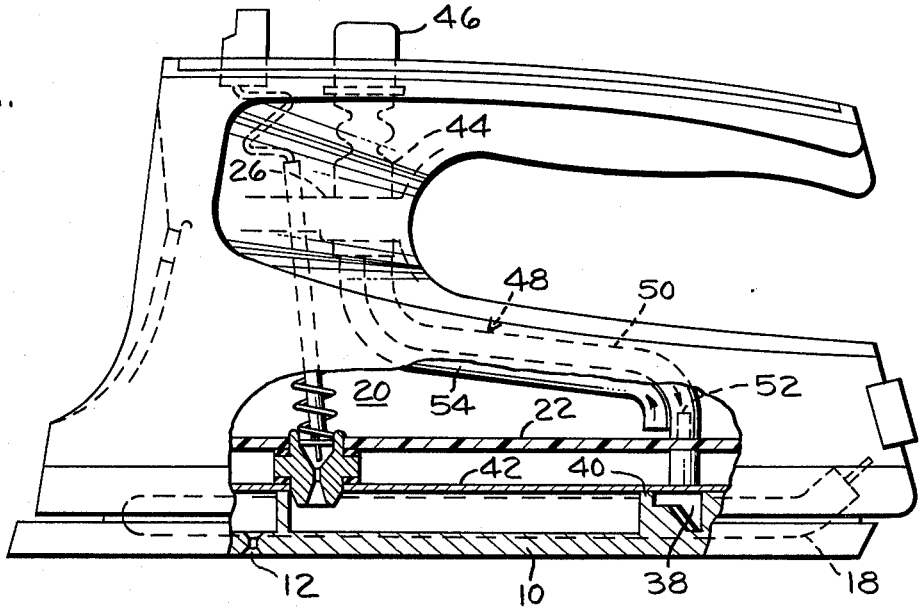
FIG. 2 is a partial sectional view, like FIG. 1, showing the invention applied for surging both horizontally and vertically.
Figure 4:
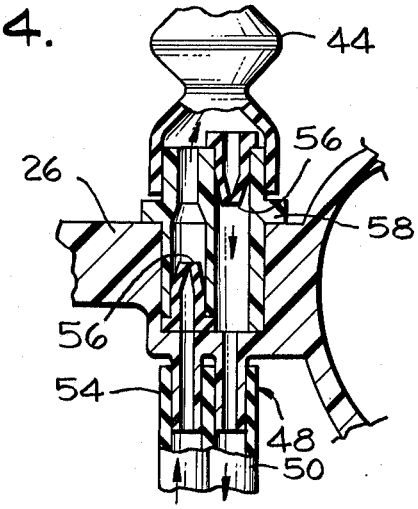
FIG. 4 is a similar partial sectional view of the valve structure as used with the invention as shown in FIG. 2.

In accordance with the present invention, the basic concept disclosed and claimed in said U.S. Pat. No. 3,986,282 is improved by the use of a simpler known bellows pump disposed entirely away from the hottest part of the iron and out of the tank, being completely external thereto, so it is not subjected to the higher temperature of tank water and soleplate, and substituting a double walled flexible heat insulated conduit of simpler construction and fewer parts over that disclosed in the U.S. Pat. No. 3,986,282. Referring to FIG. 2, the improved version of the invention is shown wherein a surge generator 38 is located at the lower rear portion of soleplate 10 with guiding ribs 40 all under coverplate 42 to direct the steam out through soleplate ports 12 in the general manner of co-pending application Ser. No. 736,381 filed Oct. 28, 1976 of common assignment. In order to direct water for an extra surge of steam to surge generator 38, without the possibility of vapor lock in the pump, there is provided a handle mounted bellows pump 44 fixedly supported on internal handle wall 26 and disposed completely external of tank 20 so that it is well removed from the tank water and heat emanating from soleplate 10. The bellows pump is actuated by surge button 46 and water is rapidly directed to the surge generator by a double conduit tubular means 48 which is connected at one end to the pump as shown in FIG. 4. For permitting the water to reach surge generator 38, one conduit 50 extends through the tank permitting preheating and terminates at the generator 38 by sliding over molded hollow tap 52 as part of the spaced bottom 22. Thus, conduit 50 terminates at and forms an exhaust outlet to surge generator 38. For operation with steam when the iron is in vertical position, the other conduit 54 acting as a suction inlet to the pump as part of and extends parallel with conduit 50 and terminates adjacent the generator 38 but in the tank 20 at its lower rear portion at the other end of the double conduit to enable all the water in the tank to be used when in the iron is in the heel rest position substantially as disclosed in said copending application.

For the iron to operate either horizontally or vertically, pump 44 must also be under the control of one way or non-position sensitive valves and to this end, as shown in FIG. 4, adjacent and oppositely directed simple duck bill valves 56 are supported in a suitable nipple 58 by a press fit which nipple 58 in turn, is supported by the internal wall 26 externally of the tank. The suction conduit 54 as shown by the arrows permits water to be drawn in from tank 20 on operation of button 46 to suck water into the bellows and to be expelled on the next stroke through exhaust conduit 50 outlet, the oppositely disposed one way duck bill valves 56 permitting such operations.

All of this is accomplished and enhanced by the use of a flexible elastomer heat insulating means for the bellows pump 44 and the double walled conduit 48. As described, in connection with FIGS. 2 and 4, the iron may be operated both horizontally and vertically for surge steam with the pump in a relatively cool position entirely external of the tank and with the use of the non-position sensitive valves supported on wall 26.

Figure 3:
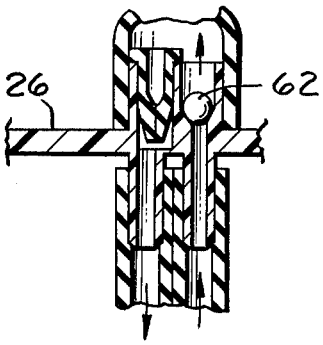
FIG. 3 is an enlarged view of the valve structure as used with the FIG. 1 modification.

If the iron is to be operated only in the horizontal position, the design may be somewhat simplified as shown in FIG. 1 and FIG. 3 wherein the double walled conduit may have its suction line 60 disposed in the bottom of the tank to lift water therefrom. In this construction, a ball check valve 62 is required and is, of course, position sensitive and will roll off the inlet valve seat if the iron is upended on the heel position. However, the invention herein is in the construction of FIGS. 2 and 4 utilizing the flexible elastomer bellows pump and double conduit with the pump entirely external of the tank and the double conduit permitting surging horizontally and vertically with non-position sensitive valves and the use of the simple duck bill valves 56. The result is greatly simplified construction that uses fewer parts and permits operation in both the horizontal and vertical surge steam positions.

While there has been described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a steam iron with a handle and fill opening to a water tank above an electrically heated soleplate and having steam generator means positioned in the lower rear portion of the iron and steam ports in the soleplate, a handle mounted pump connected to the generator to rapidly force a volume of water to the generator for a surge of steam to the ports, the improvement comprising, said pump being disposed in the upper forward portion of the handle and completely external of said tank, a double conduit tubular means connected to said pump at one end, one conduit extending through said tank and terminating at the generator and the other conduit terminating adjacent said generator in said tank rear portion, at the other end of said double conduit, said double conduit extending from said upper forward handle portion substantially slanted down to said generator and tank rear for surge generation in horizontal and vertical positions.

2. Apparatus as described in claim 1 wherein said pump and conduit are both flexible elastomer heat insulating means.

3. Apparatus as described in claim 2 wherein said pump is a bellows pump fixedly supported on an internal handle wall completely external of said tank.

4. Apparatus as described in claim 3 wherein said other conduit terminating in said tank is connected as a suction inlet to the pump and said one conduit is an exhaust outlet to the generator, one-way valves disposed oppositely in said conduits and supported by said internal wall, said valves being non-position sensitive.

5. Apparatus as described in claim 4 wherein said valves are oppositely directed elastomer duck bill valves for operation in either horizontal or vertical iron position.

* * * * *